US005316189A

United States Patent [19]

Galeros et al.

[11] Patent Number: 5,316,189

[45] Date of Patent: May 31, 1994

[54] ATTACHABLE LACE TIGHTENING HOOK AND LACE SECURING DEVICE

[76] Inventors: Susan R. Galeros, 829 Barretts Mill Rd., Concord, Mass. 01742; Judi H. Zalles, 10 Sattonstall Pkwy., Salem, Mass. 09180

[21] Appl. No.: 917,457

[22] Filed: Jul. 21, 1992

[51] Int. Cl.[5] ..... A43C 7/00

[52] U.S. Cl. ..... 223/113; 24/712.2

[58] Field of Search ..... 223/113; 24/712.2, 712.1, 24/712, 68 R, 68 SK, 68 D, 68 F

[56] References Cited

U.S. PATENT DOCUMENTS

| | | | |
|---|---|---|---|
| 1,540,810 | 6/1925 | Simon | 223/113 |
| 3,027,057 | 3/1962 | Johns | 223/113 |
| 3,149,384 | 9/1964 | Ryder | 223/113 X |
| 3,197,097 | 7/1965 | Casner et al. | 223/113 |
| 3,270,927 | 9/1966 | Wallach | 223/113 |
| 3,771,699 | 11/1973 | Thibeault | 223/113 |

*Primary Examiner*—James R. Brittain

[57] ABSTRACT

The ATTACHABLE LACE TIGHTENING and LACE SECURING DEVICE is a small hand held device comprising a slotted handle with a hole in it at one end of concavely curved shaft and a hook for pulling and tightening laces at the other end of the shaft. After the laces on the footwear have been pulled and tightened by the hook, the hook is latched onto a lower crossed-section of laces. Whereupon the handle receives the loose laces through its slots; the laces are thus secured for ease in tying. Once the laces are tied, the device is thus affixed to the footwear for ease in carrying and for decorative purposes. The hole in the handle also provides for additional means for carrying or wearing the Attachable Lace Tightening Hook and Lace Securing Device.

6 Claims, 1 Drawing Sheet

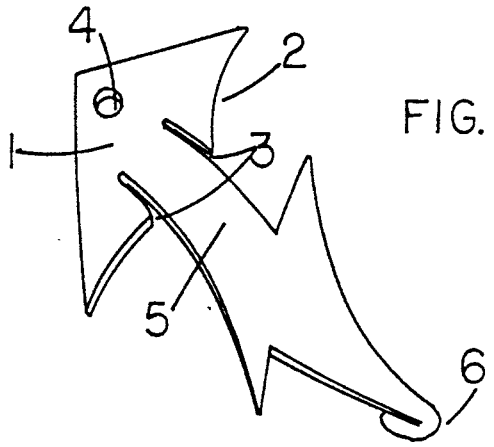
FIG. 1
FIG. 3
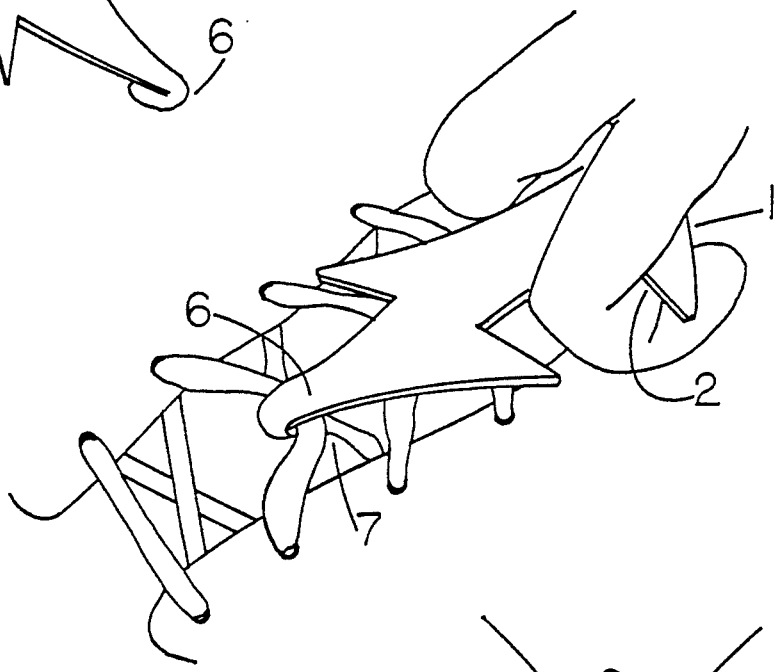
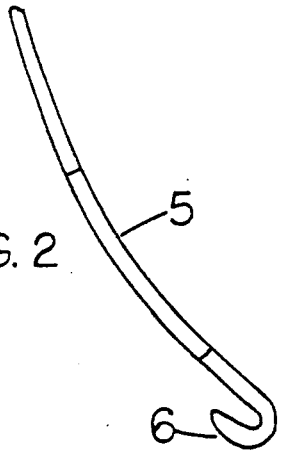
FIG. 2
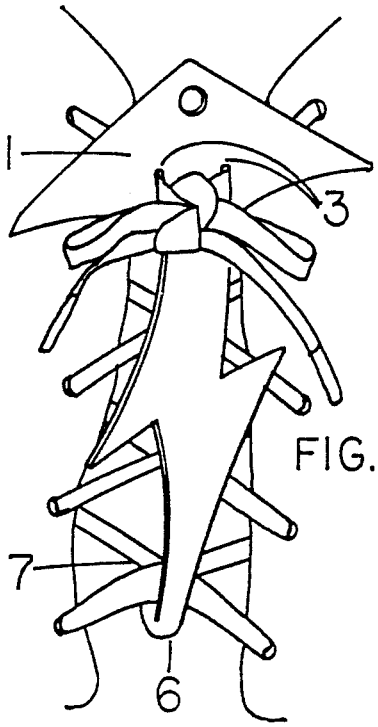
FIG. 4

ATTACHABLE LACE TIGHTENING HOOK AND LACE SECURING DEVICE

BACKGROUND OF THE INVENTION:

A. Field of the Invention

This invention relates to attachable/wearable devices for lacing, tightening, and securing laces for shoes, sneakers, skates, and any other footwear utilizing laces.

B. Description of Related and Prior Art:

Oftentimes when children or adults are trying to tighten the laces on their skates or footwear there is great difficulty in tightening the laces. When parents are required to do the aforementioned for their child, they have no way of telling when the laces are tight enough or too tight because their own foot is not in the footwear. In addition, small children lack the nimbleness and small motor control and coordination to tighten the successive number of crossed-laces successfully with their fingertips. Adults often have arthritis, or fingers too large to fit around the laces, or have long fingernails that will break, all of which often makes tightening laces a nightmare. Should one be so lucky as to get their laces tight, just when they are trying to tie the first bow loop, the laces loosen and one must start over again.

While a metal hook for pulling skate laces does exist within a very narrow distribution, children and adults have found it difficult and/or ineffective to use. The hook is too short and thick to catch under or onto the laces. In addition, when pulling on the laces for tightening, the hook slips off. The handle is awkward. Small fingers can get stuck in the loop of the handle, and the handle is too large for a child to manage. Conversely, the handle is too narrow for large or arthritic hands to grasp. Because the device is also unnecessarily long, the lacing motion is awkward, particularly for young hands. A number of parents of young children are anxious about their child handling a device resembling a poker. One must also find a place to keep it in order to have it on hand when laces loosen. The unattractive form and lack of successful function of the metal device do little to attract usage. For these reasons, the metal hooks often lie dormant in a drawer while the child and adult continue to struggle through the lace tightening and tying process.

Repeated frustration with the aforementioned device inspired us to resolve these difficulties. The Attachable Lace Tightening Hook and Lace Securing Device is the end product of a long design and experimentation process which solved the above problems, whether for children or adults. We paid attention to the details necessary for the design in the hook, the handle, and the body of the device. The hook is shaped for ease in reaching around and under the laces without slipping off. The concave curve of the device facilitates a smoother hooking and pulling motion. The handle has been sized to accommodate the average child's or adult's hand. There are no areas within which a child's fingers can get stuck or pinched. The shape of the device is more compact and does not resemble a poker. In addition, the slots in the handle of the device hold the laces securely for tying. This solves the problem of the laces loosening before they are tied. Once the laces are tied onto the handle, the device is affixed to the footwear. This provides a very natural and decorative place to always have it "on foot" for use. A hole in the handle provides a means for alternative options for carrying or wearing the device on one's person, i.e. by passing a string, chain, ring, and the like, through the hole.

SUMMARY OF THE INVENTION

This lace tightening and securing device is comprised of a body having a curved shaft portion which has a hook at one end for pulling and tightening the laces and a slotted handle at the other end, the hook is bent and the tip is narrowly tapered in such a way to be easily slipped under a crossed-section of laces and to stay hooked to the crossed-section for both pulling and tightening that crossed-section of laces, and also for securing the hook of the device to the footwear, while the handle has slots through which the top portion of the shoelaces are pulled and thusly secured to be held tight for tying, whereupon the device is firmly affixed by the handle in combination with the laces to the footwear to be worn. All portions of the device are designed with shape, size and safety considerations in handling for all ages, i.e. no sharp edges, or potential pinching areas. The device is also designed and shaped to be worn as a decoration on the footwear, as well as to be readily accessible when needed.

It is the object of this invention to provide a device to make lacing and tying easier and more fun for a full range of the population. The added feature of its capability to be affixed to the footwear, or worn elsewhere on the person also contributes to the convenience, fun and fashion in having the device on hand or "on foot" when needed.

BRIEF DESCRIPTION OF THE DRAWINGS

For illustration of our invention, reference is made to the accompanying drawings in which:

FIG. 1 is a view showing the embodiment of the Attachable Lace Tightening Hook and Lace Securing Device.

FIG. 2 is a side view of the embodiment of the invention as shown in FIG. 1 detailing the curvature of the shaft and the bend and taper of the hook.

FIG. 3 is a view of the device ensnaring, pulling, and thus tightening the laces.

FIG. 4 is a view of the [tool] device hooked to a lower crossed-section of laces and attached by tied laces so as to be worn on the footwear.

DESCRIPTION OF THE PREFERRED EMBODIMENT

As shown in the drawings, the preferred Attachable Lace Tightening Hook and Lace Securing Device FIG. 1 shows a small device which comprises a hook (#6) as a means for catching hold onto a crossed-section of laces, a curved shaft (#5) for ease in handling and conforming to the footwear, and a handle (#1) with slots for holding the device, the specifications and proportions of which have been designed to contribute to the embodiment of the integrity of the device for its function as well as its wearability.

The drawing FIG. 2 shows a side view of the embodiment of the invention wherein is shown the hook [end] (#6) with a tip bent and tapered in such a way as a means for catching around the laces. As shown in FIG. 2, this hook (#6) is bent in such a way so as to ensnare a section of crossed laces (#7) as seen in FIG. 3. This hook (#6) is also bent in such a way as to keep a hold on a crossed-lace section (#7) when pulling so as to tighten. Once a crossed-lace section (#7) has been pulled tight, a slight wrist movement allows for the hook (#6) to be easily removed from that crossed-lace (#7). Once all the crossed-sections of laces have been pulled tight, this hook (#6) is then hooked onto a lower crossed-section of laces (#7) as in FIG. 4 so as to attach said hook (#6) to the footwear. With the hook (#6) secured, the handle [end] (#1) is then tied to the footwear by way of the shoelaces being pulled up into the handle (#1) through the slots (#3) which allows the device to be worn and carried on the footwear.

The drawing, FIG. 1 shows an oblique view of the embodiment of the invention wherein is shown the handle (#1) which comprises a finger hold (#2), slots (#3), and an aperture (#4). As shown in FIG. 3, when using the device the index and middle fingers hold onto the handle on the specifically shaped finger hold area (#2) on the bottom edge of the handle (#1). The device is designed in such a way so as to allow sufficient space for the user's knuckles between the finger hold (#2) and the rest of the device.

As shown in FIG. 4, once the hook (#6) has been used to tighten all the laces, it is then hooked onto one of the lower crossed-laces (#7). The slots (#3) allow for the laces to then be slipped up into the handle (#1) where the laces are thus held in place in preparation for tying. When the laces are tied, the Attachable Lace Tightening and Lace Securing Device is conveniently secured onto the footwear as also shown in FIG. 4.

The shaft (#5) of the device, as shown in FIG. 1, is concavely curved. The specific concave curve of the shaft (#5) of the device, as seen in FIG. 2, minimizes the flexion and extension of the wrist when engaged in the lacing process. The concave curve of the shaft (#5) is also specifically designed so the device will rest comfortably along different lengths and shapes of lacing areas of a variety of footwear, once it is affixed to footwear as shown in FIG. 4. The length of the shaft (#5) is designed in such proportions so as to allow for the device to be affixed to footwear, as seen in FIG. 4. This will hold true with lacing areas of varying lengths because the hook (#6) can be hooked onto any crossed-lace section.

As shown in FIG. 1, the handle (#1) also contains an aperture (#4). This aperture (#4) provides an alternative means for the user to easily carry, hang, or wear the device on their person, by passing a string, chain, ring, etc. through the aperture.

The proportions and relationship of all the above elements create the integrity of the device which is necessary for function and wearability. The outside decorative shape and/or color and/or material of the device may change; however, the integral elements of the device as described above remain the same.

What we claim is:

1. A small hand-sized attachable lace tightening device for use in combination with laces, said device having smooth edges and consisting of an elongated shaft, a hook with a bend integral with one end of said shaft, and a triangular shaped handle having a top and integral with an opposite end of said shaft, the hook is a means for ensnaring, pulling, and attaching to a crossed-section of laces, and the handle is a means for holding and pulling the device for tightening laces, and said handle having two open-ended smooth edged slots set on opposite sides of the shaft, each having an open mouth extending through a peripheral edge on a base side of the handle, the slots used for securing laces while tying, and thusly completing attachment of said device to footwear in combination with laces, the device having a uniform thickness from the handle to the bend of the hook and being concavely curved through the shaft from the top of the handle to the bend of the hook so as to conform to the slope of the instep of the footwear when worn, whereby the attachment of said device to the footwear facilitates easy wearability, and accessibility for use.

2. A small hand-sized attachable lace tightening device for use in combination with laces as recited in claim 1, in which said shaft is comprised of a concave curve, the concave curve raising the hook in an upwardly sloped position relative to the shaft, thereby reducing the rotation necessary in the movement of the hook when catching and releasing laces, and said concave curve is sloped so said shaft rests comfortably along the lacing area of the footwear, and said shaft is also comprised of a length commensurate for attaching to the lacing section of a range of sizes and shapes of footwear.

3. A small hand sized attachable lace tightening device for use in combination with laces as recited in claim 2, in which said hook bends and tapers into a "J" shaped hook reversely bent upon itself and open towards the footwear, where said hook has a tip which tapers in width and breadth such that the hook will slide more easily under a crossed-section of laces, and said hook with a tip length and bend sized so the hook will easily ensnare, hold and pull a crossed-section of laces for tightening, as well as maintain its hold at this time without slipping off the crossed-section of laces, and said hook with the tip length and bend sized so the hook will also remain secured around a lower crossed-section of laces while said laces are held by the slots in the handle of the device while being tied, thus the device will also remain secured to the footwear for wearing.

4. A small hand sized attachable lace tightening device for use in combination with laces as recited in claim 3, in which said handle is platelike in shape, the base side of the triangle forming a lower bottom edge of the handle and forming an angle tangent to the shaft, and with the handle situated along the same surface as the shaft, with each opposing side of the lower bottom edge of said handle concavely curved as a means for helping the fingers to maintain their grip, and said handle also contains an aperture sized as a means through which a foreign member may pass to allow for an alternative choice of carrying, hanging, or wearing the device elsewhere than on the footwear, and the base side of said handle also comprised of said two open-ended smooth edged slots situated on opposite sides of the shaft.

5. A small hand sized attachable lace tightening device for use in combination with laces as recited in claim 4, in which said two slots are bilaterally symmetrical to each other, start from the lower bottom edge of the handle, extend up into the handle, and said slots provide a means through which to pull the tightened laces up into a lower portion of said handle to be secured for tying, and said slots comprised of a width sized relative to an average thickness of laces so said slots will hold laces firmly while tying, whereby the laces when tied through said slots secure the handle to the footwear, when in combination with the hook already secured to a lower crossed-section of laces, the whole device is now attached to the footwear.

6. A small hand sized attachable lace tightening device for use in combination with laces as recited in claim 5, in which the said shaft, hook and handle are integral with each other thereby comprising one united part, which allows the device to be used effectively, efficiently and safely for pulling, tightening and holding the laces of the footwear for tying, and in combination with the tied laces, allows for the device to also be worn on the footwear.

* * * * *